US009869529B2

(12) United States Patent
Gomez

(10) Patent No.: US 9,869,529 B2
(45) Date of Patent: Jan. 16, 2018

(54) FIREARM SIGHT ADJUSTMENT AND INSTALLATION TOOL

(71) Applicant: Eneko Jorge Gomez, Sant-Pee-sur-Nivelle (FR)

(72) Inventor: Eneko Jorge Gomez, Sant-Pee-sur-Nivelle (FR)

( * ) Notice: Subject to any disclaimer, the term of this patent is extended or adjusted under 35 U.S.C. 154(b) by 0 days.

(21) Appl. No.: 15/290,193

(22) Filed: Oct. 11, 2016

(65) Prior Publication Data

US 2017/0299332 A1 Oct. 19, 2017

Related U.S. Application Data

(63) Continuation of application No. 15/154,609, filed on May 13, 2016, now Pat. No. 9,464,870, which is a continuation-in-part of application No. 14/541,189, filed on Nov. 14, 2014, now abandoned.

(51) Int. Cl.
*F41G 1/54* (2006.01)

(52) U.S. Cl.
CPC ..... *F41G 1/545* (2013.01); *F41G 1/54* (2013.01)

(58) Field of Classification Search
CPC ..... F41G 1/545; F41G 1/54
USPC .... 42/90, 111, 125, 134, 137, 108, 106, 124
See application file for complete search history.

(56) References Cited

U.S. PATENT DOCUMENTS 2,599,839 A * 6/1952 Keifer, Jr. ..... F41G 1/26 254/98
2,672,775 A * 3/1954 Koski ..... G04D 1/025 269/9
2,739,500 A * 3/1956 Kordish ..... B25F 1/003 279/112
3,824,697 A * 7/1974 Into ..... F41G 1/26 42/139
3,835,594 A * 9/1974 Szulman ..... B25B 1/24 269/138
4,927,126 A * 5/1990 Hoffman ..... B25B 1/103 269/251
4,932,051 A * 6/1990 Karan ..... H01R 9/2491 361/641
5,149,071 A * 9/1992 Oliveira ..... B25B 1/20 269/152
D335,805 S * 5/1993 Ransom ..... D8/51
5,864,957 A * 2/1999 Small ..... F41G 1/54 42/111
D622,807 S * 8/2010 Stone ..... D22/199
2006/0010744 A1* 1/2006 Schumacher ..... F41C 27/00 42/1.01
2011/0252688 A1* 10/2011 Bietsch ..... F41G 1/545 42/90

(Continued)

*Primary Examiner* — John D Cooper

(74) *Attorney, Agent, or Firm* — Michael L. Greenberg, Esq.; Greenburg & Liberman, LLC

(57) ABSTRACT

A firearm sight adjustment and installation tool is described. The tool serves to facilitate and expedite the accurate adjustment and/or installation of sights on the slides of a firearm, whenever the sights allow this adjustment. The tool includes a plate, a plate with nuts, tightening screws, a spacer block, at least one adapter, a drift screw, an interchangeable pushing element and quick reference featured on one of the plates. With the tool and little expertise, an individual may manually adjust both the front and rear sights of a firearm to increase the accuracy of the firearm without additional tools.

1 Claim, 17 Drawing Sheets

(56) References Cited

U.S. PATENT DOCUMENTS

| | | | | |
|---|---|---|---|---|
| 2012/0070459 | A1* | 3/2012 | Goovaerts | A61K 39/135<br>424/216.1 |
| 2013/0255128 | A1* | 10/2013 | Fisher | F41C 27/00<br>42/108 |
| 2014/0230304 | A1* | 8/2014 | Hillwig, Jr. | F41G 1/545<br>42/90 |

* cited by examiner

FIREARM SIGHT ADJUSTMENT AND INSTALLATION TOOL

CONTINUITY

This application is a continuation application of continuation-in-part patent application Ser. No. 15/154,609, filed on May 13, 2016, and issued as U.S. Pat. No. 9,464,870, which is a continuation of non-provisional patent application Ser. No. 14/541,189, filed on Nov. 14, 2014, and priority is claimed thereto.

FIELD OF THE PRESENT INVENTION

The present invention relates generally to firearm accessories, and more specifically relates to a firearm sight adjustment and installation tool configured to facilitate and expedite firearm sight installations and adjustments.

BACKGROUND OF THE PRESENT INVENTION

Semi-Automatic handguns usually feature two sighting elements, a front sight and a rear sight. The proper alignment of these in regards of the barrel ensures that the shots strike where the shooter intends. The fore-mentioned alignment can become incorrect if the sights move on the slide due to continued battering which sights are prone to suffer during use. Firearm sights may also be inaccurate when they have been exchanged for new sights, losing the setting of the previously installed sights.

Iron sights are optical-mechanical elements normally attached at the top of the slide of semi-automatic handguns. Sights are usually mechanically secured in the desired position by the use of a dovetail, and are held by friction. Iron sights are usually changed due to the personal preference of the user of the handgun. It is not uncommon for a model of handgun to have many types of different sight designs available in the market, thus allowing the user of a handgun to configure his gun to his liking. Once the sights are changed, the alignment of these in respect of the slide is lost, and therefore re-aligned by test firing the gun, a process called sighting-in. Sighting-in is usually done at a gun range, were the gun is shot and the point of impact observed. If the point of impact if different than where the gun was aimed, the sights require adjustment. This is achieved by moving the front or rear sight.

The proper alignment of sights can traditionally only be achieved by test firing the handgun at a firing range, and then making the proper adjustments on-site. All current devices that do this task require the disassembly of the slide from the frame, which is conventionally a very inconvenient thing to do at the shooting range. Furthermore, these devices are bulky and a hassle to carry in a range bag or case. The proposed invention tackles these two major issues.

In short, sight alignment devices that exist on the market today are not catered to use on the firing range, and are therefore not easily portable. Additionally, many of the tools are ill-equipped to allow an individual to install or entirely remove a sight from a firearm while at the range.

Thus, there is a need for an apparatus such as a portable sight adjustment and installation device that enables an individual to adjust and/or install the front sight and the rear sight of a firearm without the need to remove the slide, whereby the adjustment of the firearm sights may be facilitated and expedited while at the range. Such a device is preferably smaller than traditional adjustment tools, and therefore more portable. Additionally, such a device may preferably equipped with a spacer block to provide the room necessary to remove and/or install a firearm sight to the slide of the firearm easily using the same tool used for sight adjustment.

SUMMARY OF THE PRESENT INVENTION

The present invention described herein differentiates from the prior art by having a design that allows it to be configured for sight installations as well as sight adjustments. The present invention comprises a portable solution, making it easy to transport to the firing range, and allowing the adjustment of rear sights without requiring disassembly of the handgun that needs sighting-in.

The present invention is a device for the adjustment and/or installation of sights of handguns comprising of: a plate, the plate preferably having a square shape with rounded corners and having three holes; a plate with nuts that is of a similar square shape with rounded corners, featuring three holes and three welded nuts; a quick reference which is preferably comprised of a square with a notch that resembles a rear sight, a triangle that represents the direction the sight is pushed towards, an arrow that represents the consequence action, an irregular circle that represents the point of impact, and an arrow that represents the displacement of the point of impact. Additionally, two tightening screws are preferably included, each having a shaft with a threaded portion with a step and a knob; a drift screw being this comprised of a shaft with a threaded portion, a threaded hole and knob; an interchangeable pushing element comprised of a threaded shaft, unthreaded portion, and (in some embodiments) a domed face. In some embodiments, the domed face may one of many interchangeable pushing elements having one of a variety of shapes and/or material compositions. The plate and plate with nuts are preferably independent components, connected together by two tightening screws, creating a space that allows the present invention to clamp to the slide of a handgun. The interchangeable pushing element pushes the sight that needs adjustment by the means of the axial advancing movement provided by the drift screw.

The present invention also relates to the methods for using a device for the adjustment or installation of sights of handguns, this method comprising the steps of: a handgun requiring sight adjustment or installation. Then the user assembles an embodiment of the present invention. Next, the user checks the quick reference disposed on the plate with nuts for the orientation of the assembly of the embodiment in regards to the slide of the handgun. Then, the user locks the slide of the handgun back. Then, the user installs adapters according to the make and/or model of the handgun to be sighted. Masking tape may alternatively be applied to the slide in the event that adapters are not included, or are not needed for the handgun. If a sight installation or removal is being performed, a spacer block is disposed between the plate and the adapter disposed opposite of the plate with nuts. The spacer block is preferably held in position via a magnet against the plate or plate with nuts. Then, the slide is placed between the adapters, disposed between the plates of the present invention, and the user positions the sight of the handgun within reach of the interchangeable pushing element. Next, the user tightens the tightening screws, causing the adapters to compress against the slide of the firearm. Then, the user adjusts the sight of the firearm by tightening the drift screw, compressing the interchangeable pushing element into the sight on the slide of the handgun.

Finally, the user disassembles the device of the present invention, removing it from the slide of the handgun. The user then test fires the handgun, checking for increased or decreased accuracy to determine the success of the sight adjustment or installation.

The main object of the device of the present invention is the non-requirement of handgun disassembly for rear sight adjustments. An additional object of the present invention is to provide a device that does not damage the sight or the slide during operation. A further object of the present invention is to provide a device that is easy to transport and to use on-site at the firing range. Another object of the present invention is to provide a device that can be used without any external or independent devices. A further object of the present invention is to provide a device which is simple and inexpensive to manufacture.

A further object of the present invention is to provide a device that can be used in a wide variety of models of firearms and firearm sights. As such, the present invention is preferably equipped with a variety of adapters configured to enable the device of the present invention to facilitate the adjustment of sights on a vast majority of handguns. A further object of the invention is to provide a device which has an interchangeable pushing element, which may be interchanged at the will of the user with an alternate pushing element fashioned of different materials and shapes. As such the user will select and install the appropriate pushing element according to the shape and fit of the sight that needs adjustment. This allows for safer and easier sight adjustment and installation which minimizes the risk of causing damage to the sight or the firearm itself.

The present invention is also preferably equipped with a quick reference guide disposed on a side of the device for the user to easily know how to use the device while the device is in-hand. A further object of the invention is to provide a device which can be used to adjust both the front and rear sights of a handgun.

The drift screw tip and the drift screw, despite being two separate parts, are permanently screwed together and are not meant for disassembly. The drift screw is screwed through the center nut of the plate with nuts. The interchangeable pushing element is inserted on the drift screw tip, and the guiding plate is inserted through the slots of the interchangeable pushing element. Due to the inner diameter of the drift screw tip being larger than that of the inner width of the legs of the guiding plate, this part snaps in place once the inner diameter portion gets to the cut present on the guiding plate legs.

A tightening screw is inserted through a hole of the plate, then through the guiding plate bushing and finally it is screwed in on to the top screw of the plate with nuts. Afterwards, the second tightening screw is inserted in the opposite hole of the plate and screwed into position at the bottom of the plate with nuts. Depending on the task, the long tightening screws will be used for sight installations (using the spacer block) or the short ones for sight adjustment. The short screws can also be used for sight installations on guns with very narrow slides such as sub-compact models.

Once the basic structure of the present invention is assembled, the spacer block and the adapters are attached to the tool. For sight removals, the spacer block is assembled on the plate, whereas for sight installations, the spacer block is assembled on the plate with nuts. For sight adjustments, only the adapters are assembled onto the tool, if required, omitting the spacer block for the sight adjustment only.

BRIEF DESCRIPTION OF THE DRAWINGS

The present invention is illustrated by way of example, and not by way of limitation, in the figures of the accompanying drawings and in which like reference numerals refer to similar elements in which.

DETAILED DESCRIPTION OF THE PREFERRED EMBODIMENT

The present invention will now be described in detail with reference to a few embodiments thereof as illustrated in the accompanying drawings. In the following description, numerous specific details are set forth in order to provide through understanding of the present invention. It will be apparent, however, to one skilled in the art, that the present invention may be practiced without some or all of the specific details. In other instances, well known processes, steps, and/or structures have not been described in detail in order to not unnecessarily obscure the present invention.

The schematic flow chart included is generally set forth as a logical flow chart diagram. As such, the depicted order and labeled steps are indicative of one embodiment of the present method. Other steps and methods may be conceived that are equivalent in function, logic, or effect to one or more steps, or portions thereof, of the illustrated method.

Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connector may be used to indicate only the logical flow of the method. For instance, an arrow may indicate a waiting or monitoring period of unspecified duration between enumerated steps of the depicted method. Additionally, the order in which a particular method proceeds, may or may not strictly adhere to the order of the corresponding steps shown.

Figure 1:
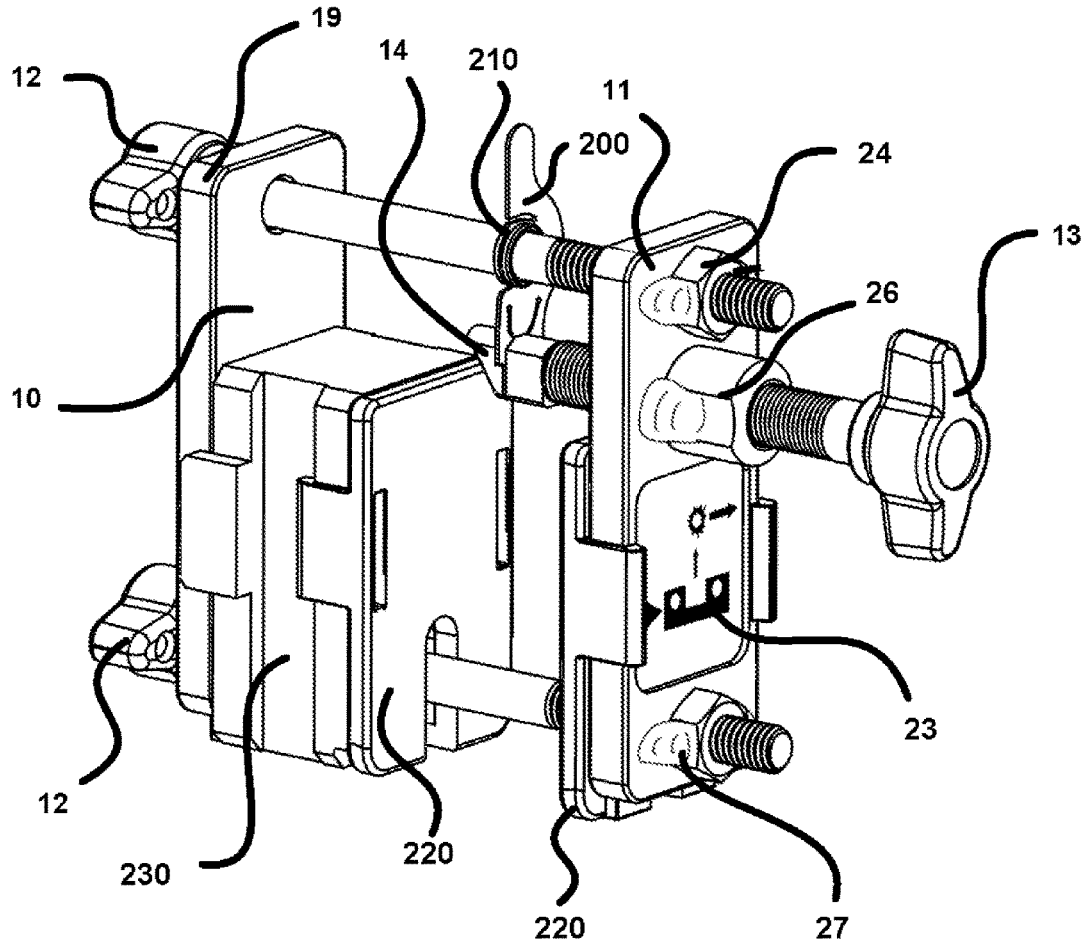
FIG. 1 is an illustrative representation of a device for the adjustment and installation of sights of handguns in accordance with the preferred embodiment of the present invention.
Figure 17:
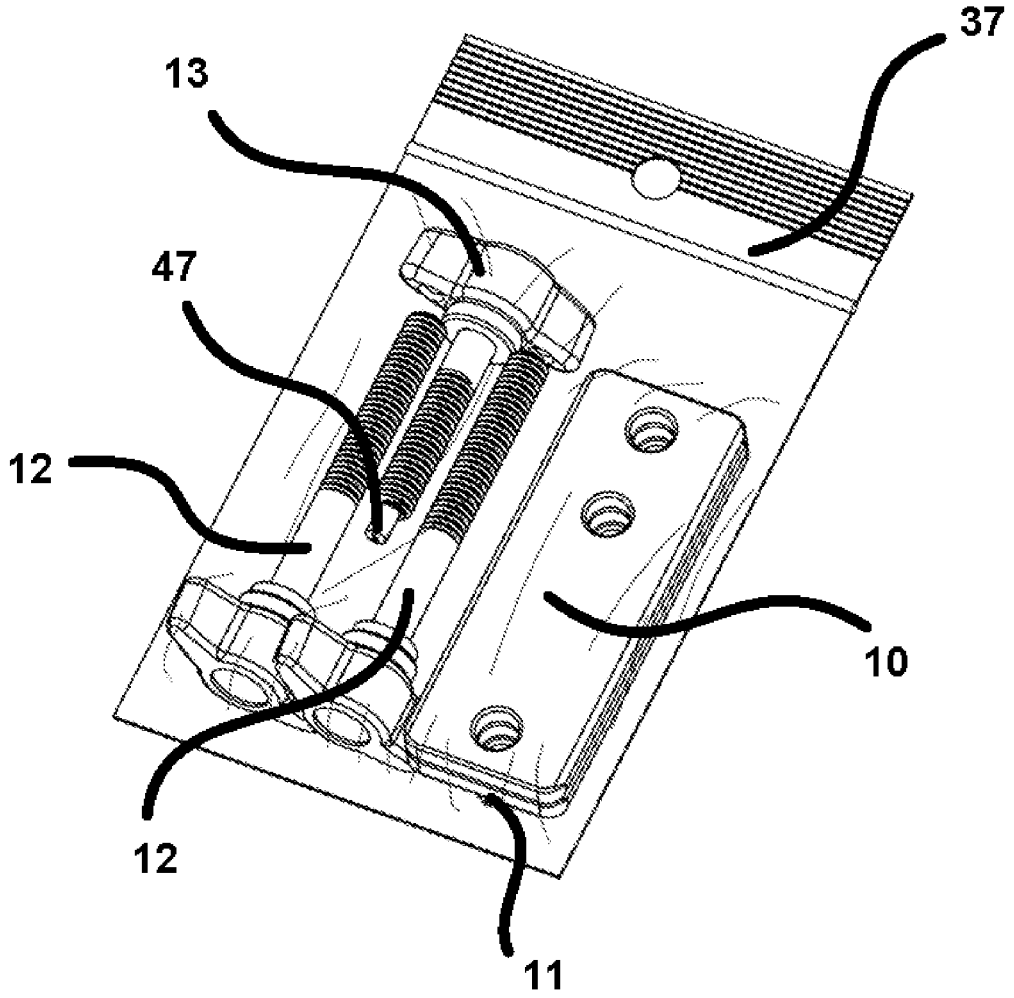
FIG. 17 exhibits an example of the present invention stored away in a packaging for transport and/or sale.

Starting in FIG. 1, the embodiment of a device for the adjustment of sights of handguns is depicted. This embodiment is composed of several components which include: a plate 10, plate with nuts 11, a guiding plate 200, a guiding plate bushing 210, a tightening screw 12, drift screw 13, a spacer block 230, at least one adapter 220, and an interchangeable pushing element 14. The plate 10 is of elongated rectangular shape, featuring rounded corners 19 in the extremes. These rounded corners make the piece more pleasant to hand manipulation, and they avoid tearing the interior of plastic or fabric bags during transportation. Anyone skilled in the art would know that a similar effect can be achieved by chamfering. It is envisioned that the present invention is configured to store in a slim-fitting case such as a zip bag, or other dense plastic bag or box. An example of a packaging 37 of the present invention can be seen in FIG. 17.

Figure 4:
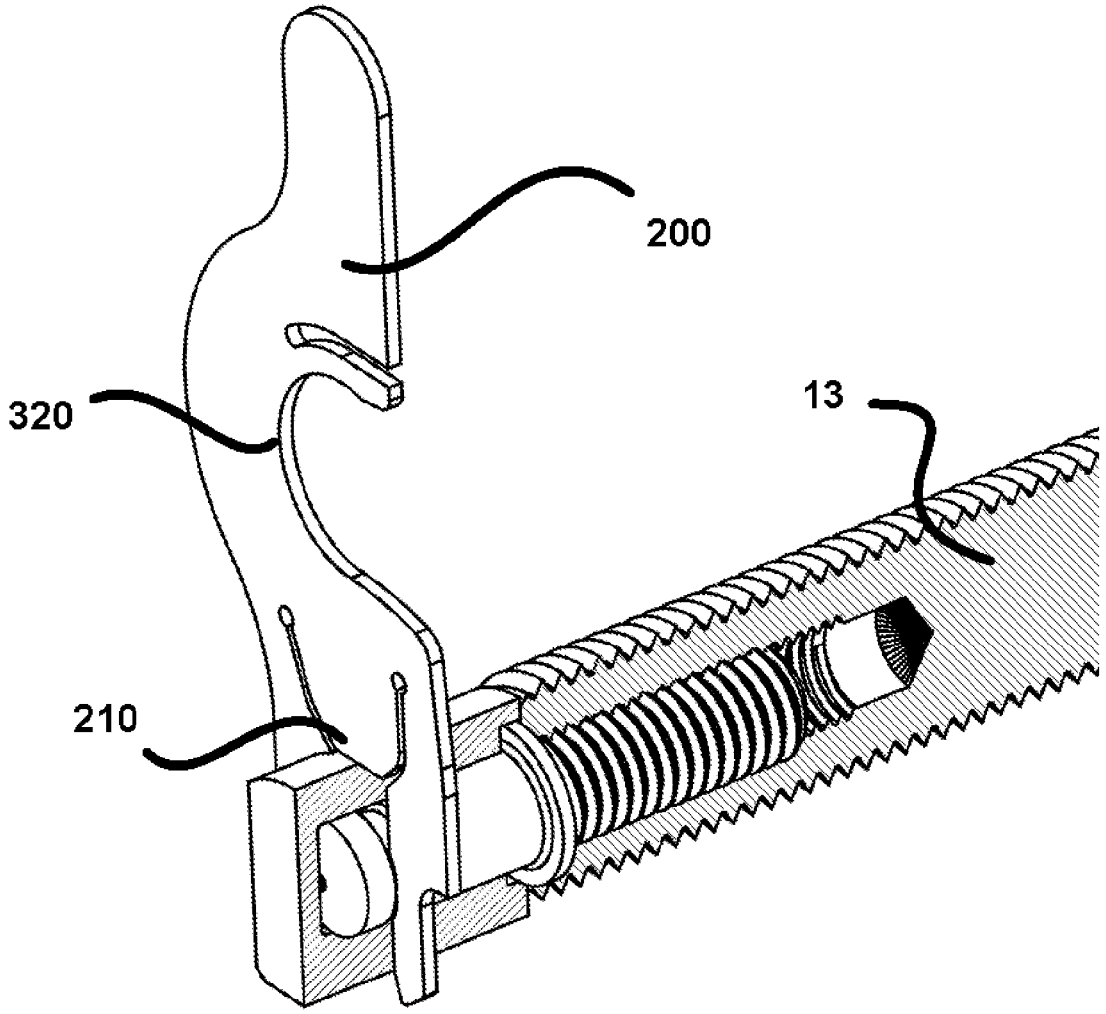
FIG. 4 displays a close-up view of the guiding plate of the present invention without spacer block, showing the guiding plate in detail.

The guiding plate 200 of the present invention can be seen in detail in FIG. 4. The guiding plate 200 is preferably equipped with a guiding plate bushing 210 disposed at a bottom of the guiding plate 200. Additionally, a tightening screw interface 320 is disposed at a top of the guiding plate 200, and is configured to interface with the tightening screw 12 during use, maintaining the alignment of the guiding plate 200 in the desired position. Alternate embodiments of the guiding plate 200 of the present invention may not be equipped with a guiding plate bushing 210, and instead are equipped with a tightening screw interface 320 that is closed such that it forms a closed circle around the tightening screw 12 when assembled. Additionally, the guiding plate 200 is configured to limit the upward movement of the interchangeable pushing element 14 by resting on the top tightening screw 12.

Figure 15:
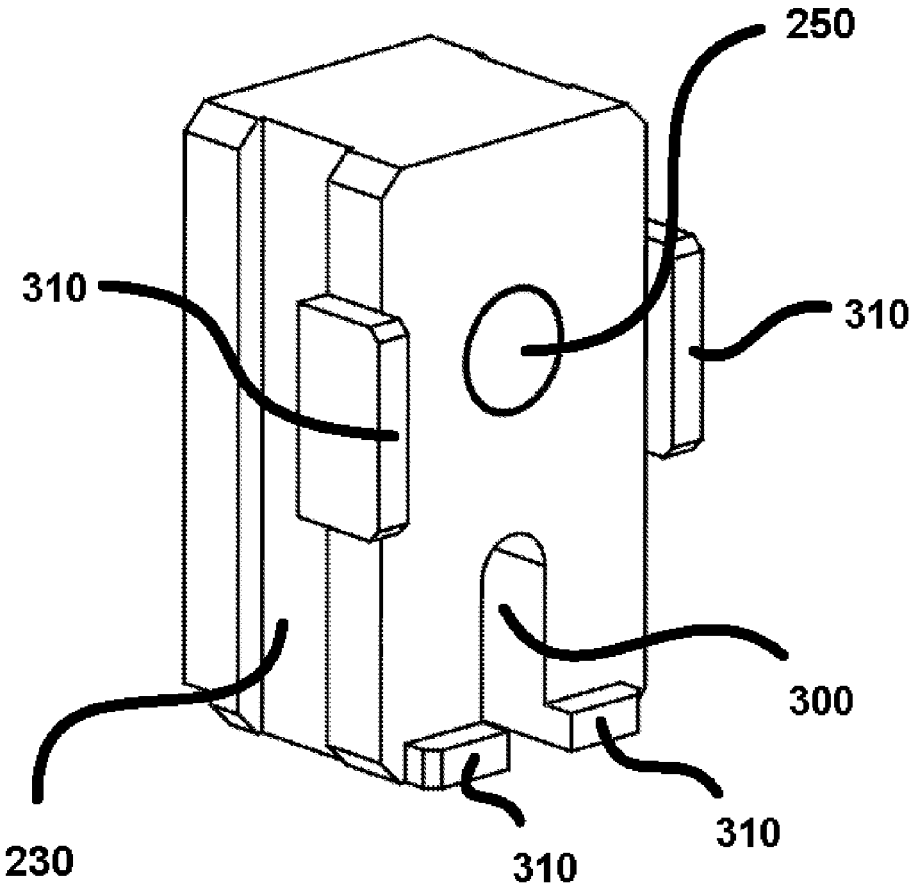
FIG. 15 displays a close-up, rear view of the spacer block of the present invention, detailing the magnet.
Figure 16:
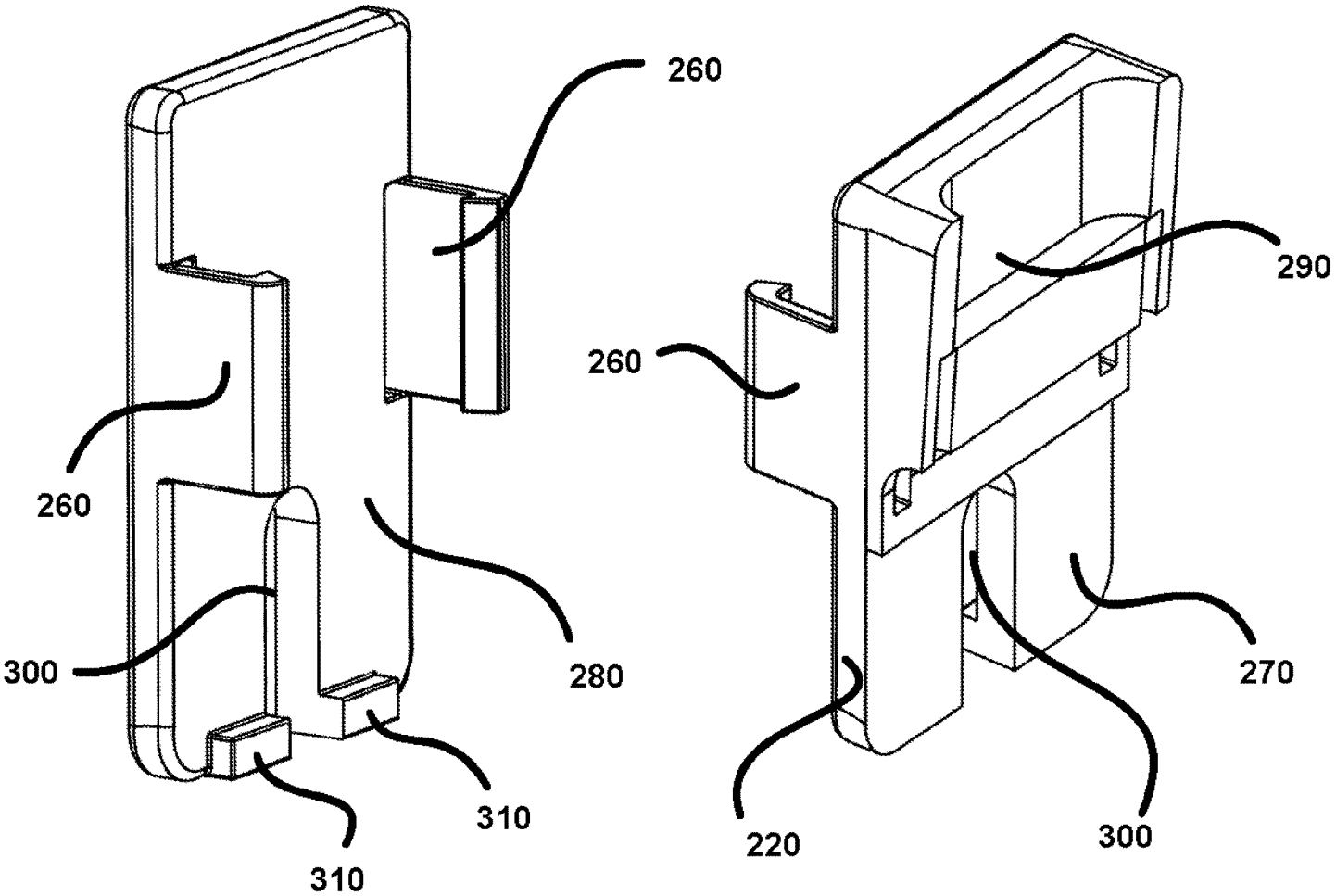
FIG. 16 displays a close-up, front view and rear view of the at least one adapter of the present invention.

The adapters 220 of the present invention are unique in that they enable the device of the present invention to function with a wide variety of handgun makes and models comprising a wide assortment of sizes. Many handguns are equipped with mechanical or cosmetic protrusions at or near the sight, which would otherwise cause the slide of the handgun to be insufficiently held in position between the plate 10 and plate with nuts 11 of the present invention. As such, adapters 220 are employed to provide additional spacing via an adapter accommodation 290, as seen in FIG. 16. The adapter accommodation 290 is preferably disposed on the adapter front 270. The adapters 220 are preferably held in position via at least one adapter clasp 260, which facilitates the clipping of the adapters 220 to the plate 10, plate with nuts 11, and/or the spacer block 230. The at least one adapter clasp 260 of the present invention are preferably flexible such that they may be forced outwards by hand to affix the at least one adapter clasp 260 to the plate 10 and plate with nuts 11 (or the spacer block 230 during sight installation or removal). The spacer block 230 and adapters 220 are preferably equipped with an open bottom 300 as shown in FIG. 15 and FIG. 16, which enables the spacer block 230 and/or attached adapters 220, to be removed from the device without the need to disassemble the tool. Protrusions 310 are disposed on the spacer block 230, as well as on the adapter 220 to facilitate the alignment of the spacer block 230 and/or the spacers against the plate 10 and/or plate with nuts 11.

The adapters 220 of the present invention not only allow for the 'masking tape-free' use of the present invention, but also enable use of the present invention on slides with steps (such as the slide found on the Springfield TM XD), tapers (such as those found on the Springfield TM XDM), slide-mounted safeties (such as those found on the Beretta 92), or other special cases, including the H&K TM VP9, which features a tapered slide and slide cocking protrusions. This is achieved by varying the shape of the surface of the adapter 220 that contacts the slide of the handgun, shown as the adapter accommodation 290 in FIG. 16. The adapters 220 of the present invention are preferably fashioned of a hard thermoplastic, such as polyamide. However, alternative plastics may be employed, including nylon, polypropylene, ABS plastic, and other similar plastics. Additionally, portions of the adapters 220 may be fashioned of soft, moldable metals such as zinc alloys, aluminum, and/or bronze. Similarly, metal injection molding (MIM) metals may alternatively be employed in the manufacturing of the adapters 220.

In the preferred embodiment of the present invention, the plate 10 further features a top hole 16, a center hole 17, and a bottom hole 18. The top hole 16 and the bottom hole 18 are meant for the tightening screws 12 to pass through. The center hole 17 allows the drift screw 13 to pass through when the plate 10 and plate with nuts 11 are resting one on top of another. An added functionality of the center hole 17 is to weaken the plate 10 and make it more prone to bending. The at least one adapter 220 is preferably disposed between the plate 10 and the plate with nuts 11 to provide a correct fit for the firearm in need of sight adjustment, as well as to protect the slide of the firearm from damage during adjustment or installation. This allows the user of the embodiment to better control the tightening of the embodiment to the slide 36*a*, and be more aware of the force applied with the drift screw 13 to the interchangeable pushing element 14 such that it does not create an indentation in the rear sight 35*a*. Anyone skilled in the art would know that this feature can be calibrated by varying the thickness of the plate 10. In certain embodiments, the center hole 17 is omitted.

In certain embodiments, the plate 10 is made out of steel. In certain embodiments, plate 10 is made out of aluminum. In certain embodiments, the plate 10 is made out of brass. In other certain embodiments, the plate 10 is made out of plastic. In certain embodiments, the plate 10 is made out of a combination of materials mentioned thereof.

In certain embodiments, the plate 10 has a rust and wear resistant surface finish like phosphating. In certain embodiments, the plate 10 has a rust and wear resistant surface finish like bluing. In certain embodiments, the plate 10 has a rust and wear resistant surface finish like paint. In certain embodiments, the plate 10 has a rust and wear resistant surface finish like a Physical Vapor Deposition (PVD)

coating. In other certain embodiments, the plate 10 has a rust and wear resistant surface finish such as Zinc plating. In certain embodiments, the plate 10 has a rust and wear resistant surface finish like Chrome plating. In certain embodiments, the flat surface that contacts with the slide 20 of plate 10 has a plastic over-coating or molding.

Figure 2:
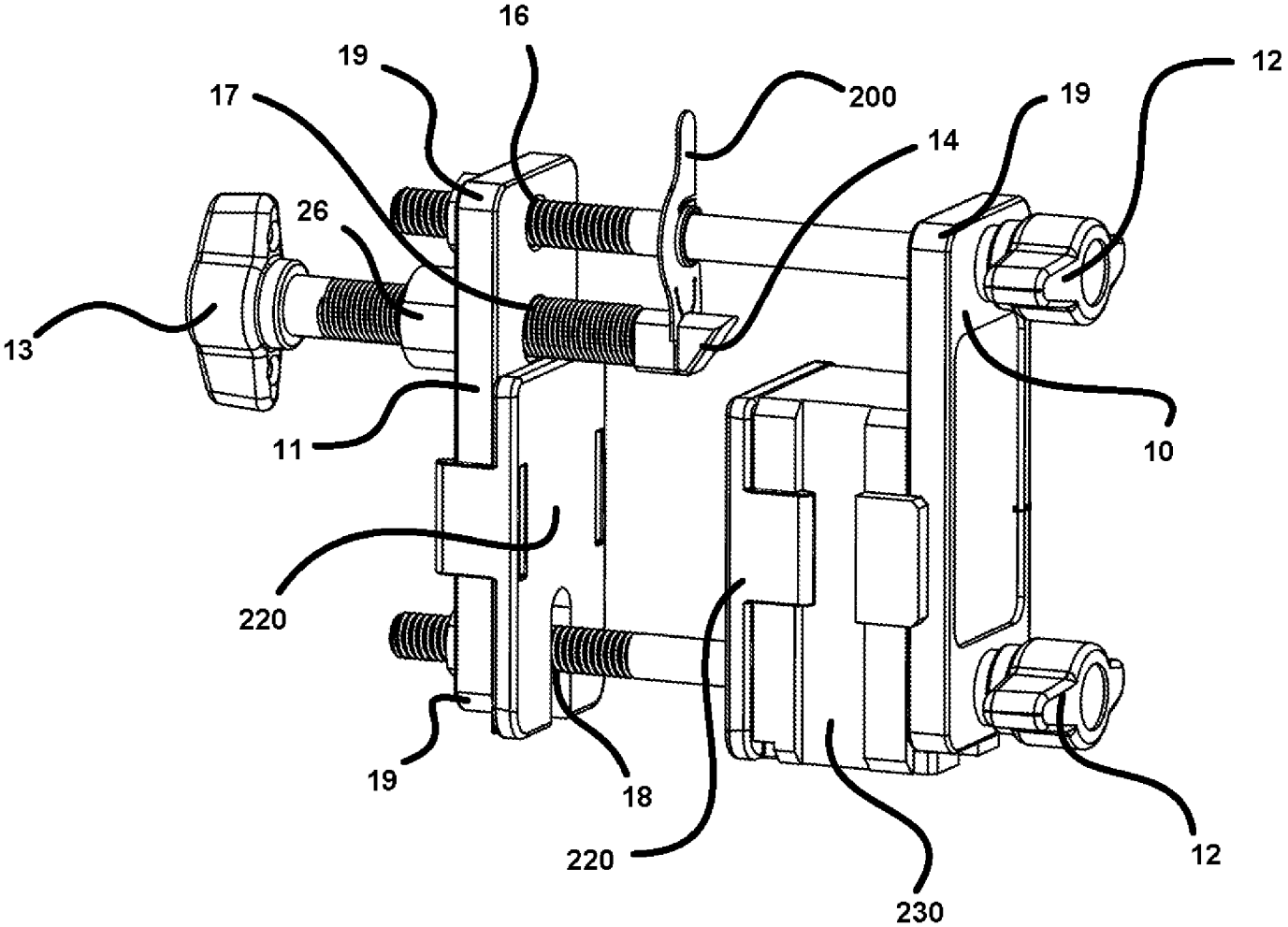
FIG. 2 depicts a left side view of the preferred embodiment of the present invention.

Continuing in FIG. 2, the plate with nuts 11 is of an elongated rectangular shape, featuring rounded corners 19 in the extremes. These rounded corners 19 make the piece more pleasant to hand manipulation and they avoid tearing the interior of plastic or fabric bags during transportation. Anyone skilled in the art would know that a similar effect can be achieved by chamfering. It should be noted that the spacer block 230 of the present invention need only be in position as shown in FIG. 2 in cases where the sight is being installed to, or removed from, the firearm slide. It should be understood that the spacer block 230 affords the present invention with additional space between the plate 10 and the plate with nuts 11 such that the sight may be removed from, or installed to the firearm slide without binding against either the plate 10 or the plate with nuts 11 during use.

The plate with nuts 11 further features a top hole 16, a center hole 17 and a bottom hole 18. The top hole 16 and the bottom hole 18 are meant for the tightening screws 12 to pass through. The center hole 17 allows the drift screw 13 to pass through. On the opposite side of the top hole 16, the top nut 24 is welded in place. The top nut 24 is coaxial to the top hole 16. On the opposite side of the center hole 17, the center nut 26 is welded in place. The center hexagonal nut is coaxial to the top hole 16. On the opposite side of the bottom hole 18, the bottom nut 27 is welded in place. The center nut 26 is coaxial to the center hole 17. In certain embodiments of the present invention, the center hole 17 and the center nut 26 are not coaxial. In certain embodiments, the center nut 26 is taller or not equal size or type to the top nut 24 and the bottom nut 27.

In certain embodiments, the top nut 24, the center nut 26 and the bottom nut 27 are integral part of the plate with nuts 11. The illustrated weld 28 is performed by the MAG method. In certain embodiments, the weld 28 is performed by the TIG method. In certain embodiments the weld 28 is performed by the resistance method. In certain embodiments, the plate with nuts 11 is made out of steel. In certain embodiments, plate with nuts 11 is made out of aluminum. In certain embodiments, the plate 11 is made out of brass. In certain embodiments, the plate with nuts 11 is made out of plastic. In certain embodiments, the plate with nuts 11 is made out of a combination of materials mentioned thereof In certain embodiments, the plate with nuts 11 has a rust and wear resistant surface finish like phosphating. In certain embodiments, the plate with nuts 11 has a rust and wear resistant surface finish like bluing. In certain embodiments, the plate with nuts 11 has a rust and wear resistant surface finish like paint. In certain embodiments, the plate with nuts 11 has a rust and wear resistant surface finish like PVD. In certain embodiments, the plate with nuts 11 has a rust and wear resistant surface finish like Zinc plating. In certain embodiments, the plate with nuts 11 has a rust and wear resistant surface finish like Chrome plating. In certain embodiments, the flat surface that contacts with the slide 20 of plate with nuts 11 has a plastic over molding.

Figure 8A:
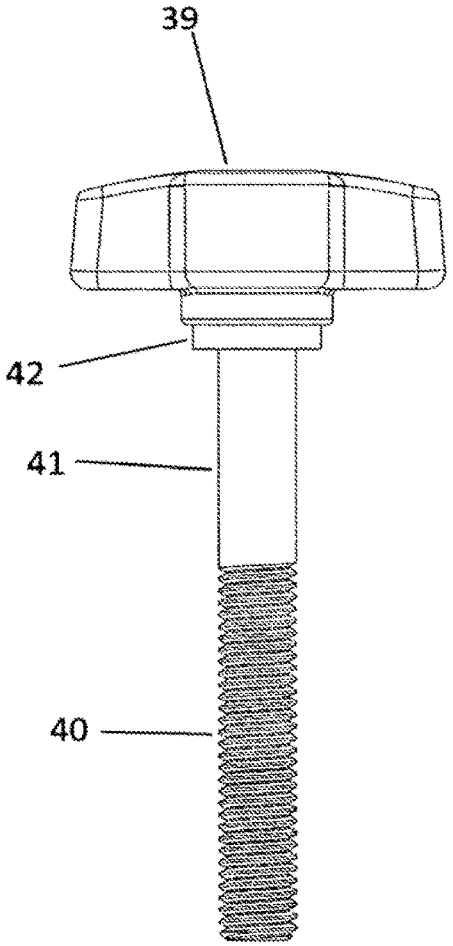
FIG. 8*a* is an illustrative representation of a tightening screw in accordance with the embodiments of the present invention.

As illustrated in FIG. 8*a*, the tightening screw 12 is comprised by a shaft 41 with a threaded portion 40. The threaded portion 40 is sufficient as to allow the use of the embodiment in a thin slide 36*a* but not enough as to the user to be capable of crushing his or her fingers between the plate 10 and plate with nuts 11. At the top of the shaft 41 there is the step 42. This is an integral part of the shaft 41 and prevents the knob 39 from being sheared off from the tightening screw 12. The shaft 41 and the knob 39 are integral parts, but in certain embodiments, these are separate items.

In certain embodiments, the tightening screw 12 has a rust and wear resistant surface finish like phosphating. In certain embodiments, the tightening screw 12 has a rust and wear resistant surface finish like bluing. In certain embodiments, the tightening screw 12 has a rust and wear resistant surface finish like paint. In certain embodiments, the tightening screw 12 has a rust and wear resistant surface finish like PVD. In certain embodiments, the tightening screw 12 has a rust and wear resistant surface finish like Zinc plating. In certain embodiments, the tightening screw 12 has a rust and wear resistant surface finish like Chrome plating.

Figure 8B:
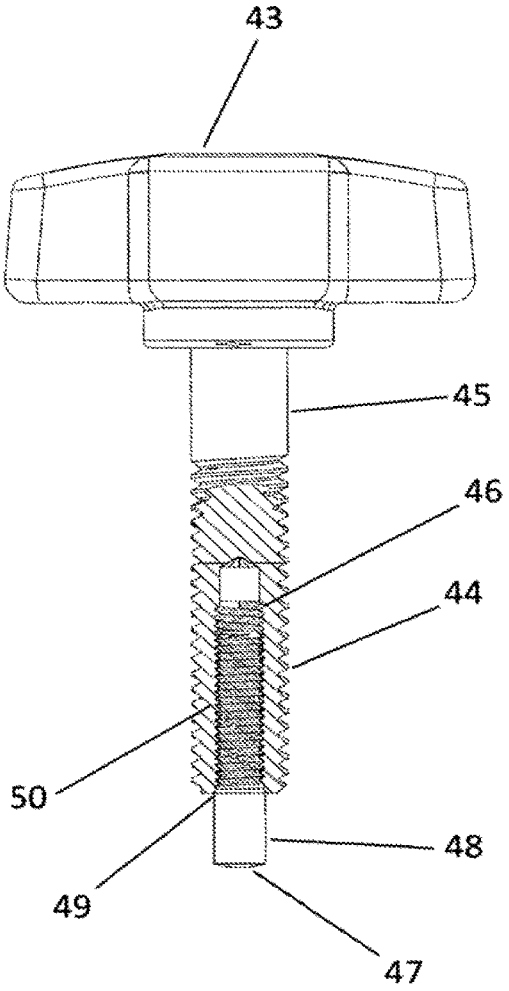
FIG. 8*b* is an illustrative representation of a drift screw with interchangeable pushing element in accordance with the embodiments of the present invention.
Figure 9:
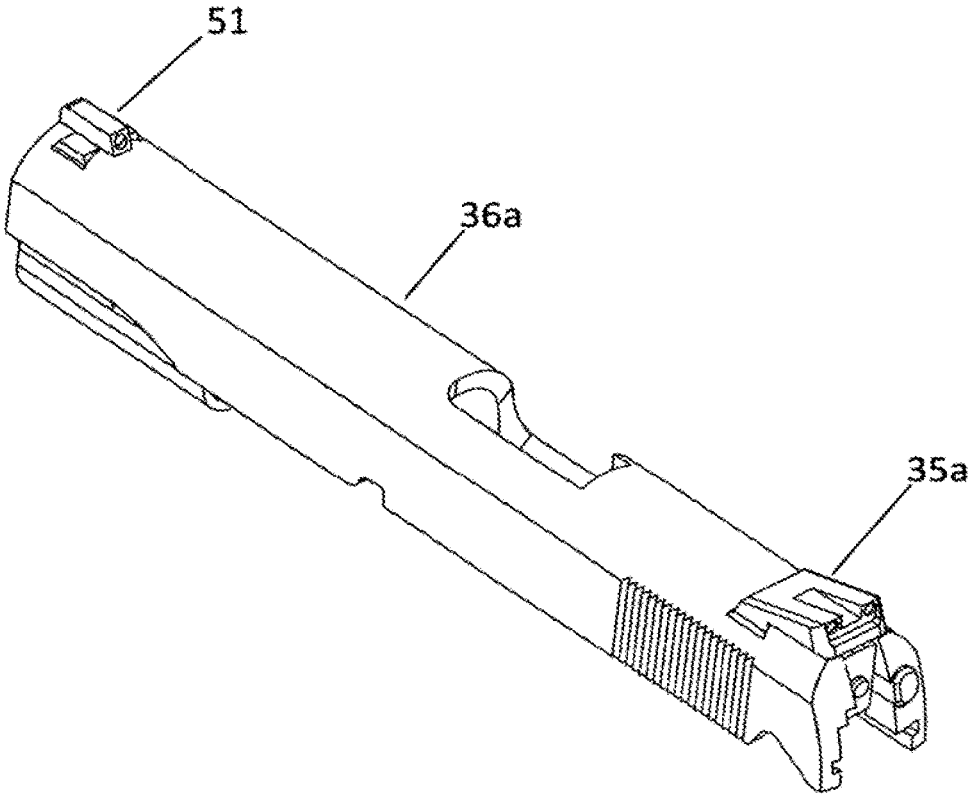
FIG. 9 is a perspective view of a handgun slide featuring a front and a rear sight.

As illustrated in FIG. 8*b*, the drift screw 13 is comprised by a shaft 45 with a threaded portion 44. The threaded portion 44 is sufficient as to allow the interchangeable pushing element 14 to reach fronts sights 51. The top of the shaft 45, there is a knob 43. The shaft 45 and the knob 43 are integral parts, but in certain embodiments, these are separate items. The shaft 45 includes a threaded hole 46 where the interchangeable pushing element 14 is inserted. In certain embodiments, the threaded portion 44 is long enough as to clear completely the slide 36*a* side to side.

In certain embodiments of the present invention, the drift screw 13 has a rust and wear resistant surface finish like phosphating. In certain embodiments, the drift screw 13 has a rust and wear resistant surface finish like bluing. In certain embodiments, the drift screw 13 has a rust and wear resistant surface finish like paint. In certain embodiments, the drift screw 13 has a rust and wear resistant surface finish like PVD. In certain embodiments, the drift screw 13 has a rust and wear resistant surface finish like Zinc plating. In certain embodiments, the drift screw 13 has a rust and wear resistant surface finish like Chrome plating.

Figure 11:
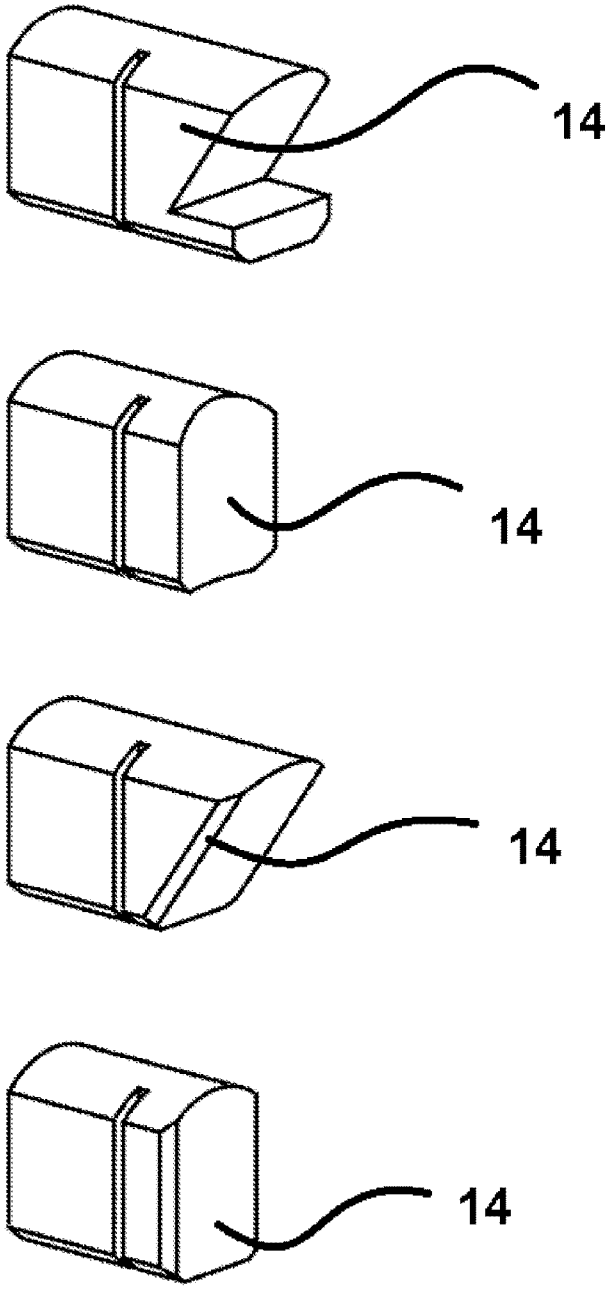
FIG. 11 exhibits alternate embodiments of the interchangeable pushing element of the present invention as shown from the front and side.
Figure 12:
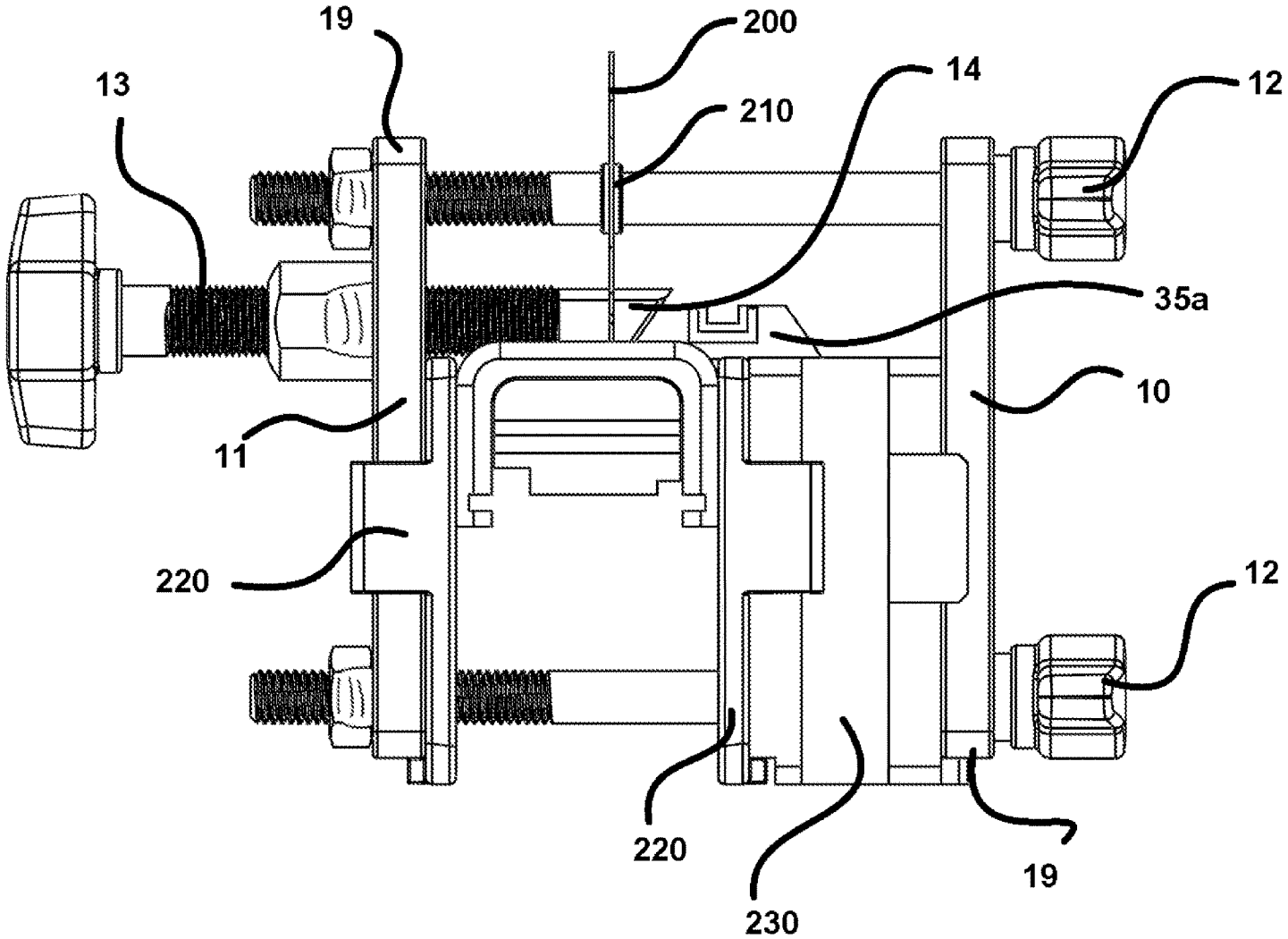
FIG. 12 displays a front view of the present invention shown in use during a sight removal from a handgun.

Continuing in FIG. 8*b*, the interchangeable pushing element 14 is composed by a threaded portion 50, a unthreaded portion 48 and a domed face 47, or an interchangeable extension thereof, as shown in FIG. 11, detailing alternate pushing heads or tips configured to interface with the domed face 47. It should be understood that the domed face 47 of the present invention is the drift screw tip to which the interchangeable pushing element 14 is preferably affixed. Some alternate embodiments of the interchangeable pushing element 14 are not equipped with a domed face, as shown in FIG. 11. The domed face 47 allows the accommodation of the pushing element 14 to various sight profiles like sight 35*b*. The step 49 between the unthreaded portion 48 and the threaded portion 50 creates a lock in the rotation of the interchangeable pushing element 14 during use.

The material choice of the interchangeable pushing element 14 can allow this embodiment to deform or bend to avoid indentations in the sight of the firearm. In certain embodiments, the material for the interchangeable pushing element 14 is brass. In certain embodiments, the material for the interchangeable pushing element 14 is soft steel. In certain embodiments, the material for the interchangeable pushing element 14 is hardened steel. In certain embodiments, the material for the interchangeable pushing element 14 is plastic. Anyone skilled in the art would know that by changing the shape of the unthreaded portion 48, the bending and mushing characteristics of the interchangeable pushing element 14 can be altered.

Figure 13:
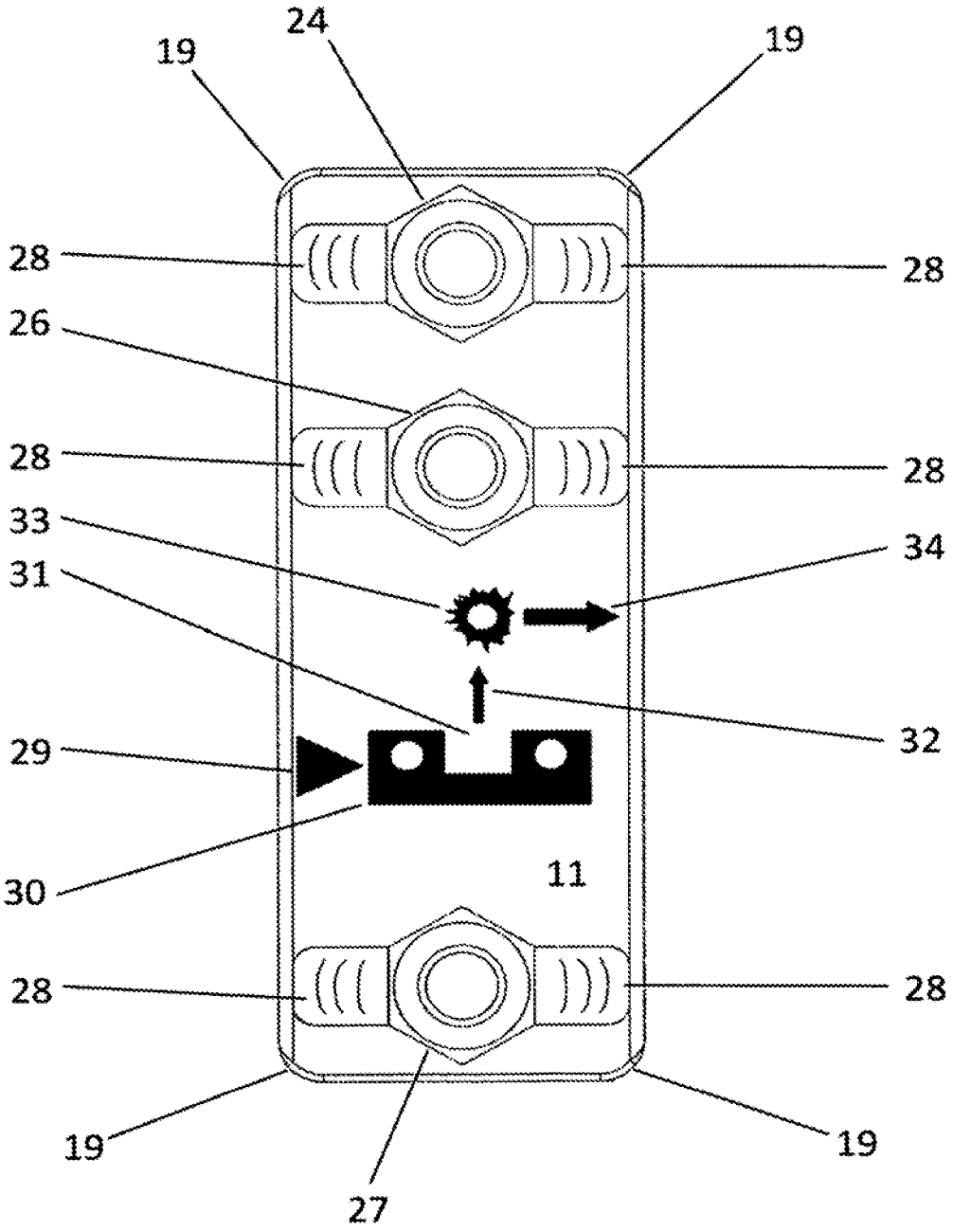
FIG. 13 depicts the side of the present invention, detailing the quick reference of the present invention.

The quick reference 23 is composed of several shapes that represent part of the sight adjustment process. As seen in FIG. 13, a rear sight 35*a* is represented by a square 30 with a notch on top 31. In certain embodiments, other elements may be added to the basic shape to further clarify its representation. A triangle 29 represents the pushing action of the interchangeable pushing element 14 on the left side of a rear sight 35*a*. The arrow 32 situated on top of the notch 31 is a process flow representation. The circle with irregular outline 33 is situated on top of the arrow 32 represents the impact point of a projectile on a target. The arrow 34 situated on the right of the circle with irregular outline 31 represents the impact point of the bullet moving to the right. Overall, the quick reference 23 is read as follows: "When a rear sight 30 is pushed on the left side 29, it causes (arrow) 32 the impact point 33 to move to the right 34".

In the preferred embodiment, the quick reference 23 is situated on the plate with nuts 11 between the center nut 26 and the bottom nut 27. In certain embodiments, the quick reference 23 is situated on the plate 10 between the center hole 17 and the bottom hole 18. In certain embodiments, the quick reference 23 is omitted. In certain embodiments the quick reference 23 is laser engraved. In certain embodiments the quick reference 23 is silk-screen printed. In certain embodiments the quick reference 23 is a sticker.

As represented on FIG. 1 and FIG. 2, the plate 10 and plate with nuts 11 are individual independent parts assembled in a parallel manner, oriented and connected by two tightening screws 12. Between the plates, a slide from a handgun 36*a* or 36*b* can be inserted and then be grabbed at the clamping area featured on both plate 10 and plate with nuts 11 thereof.

Figure 14:
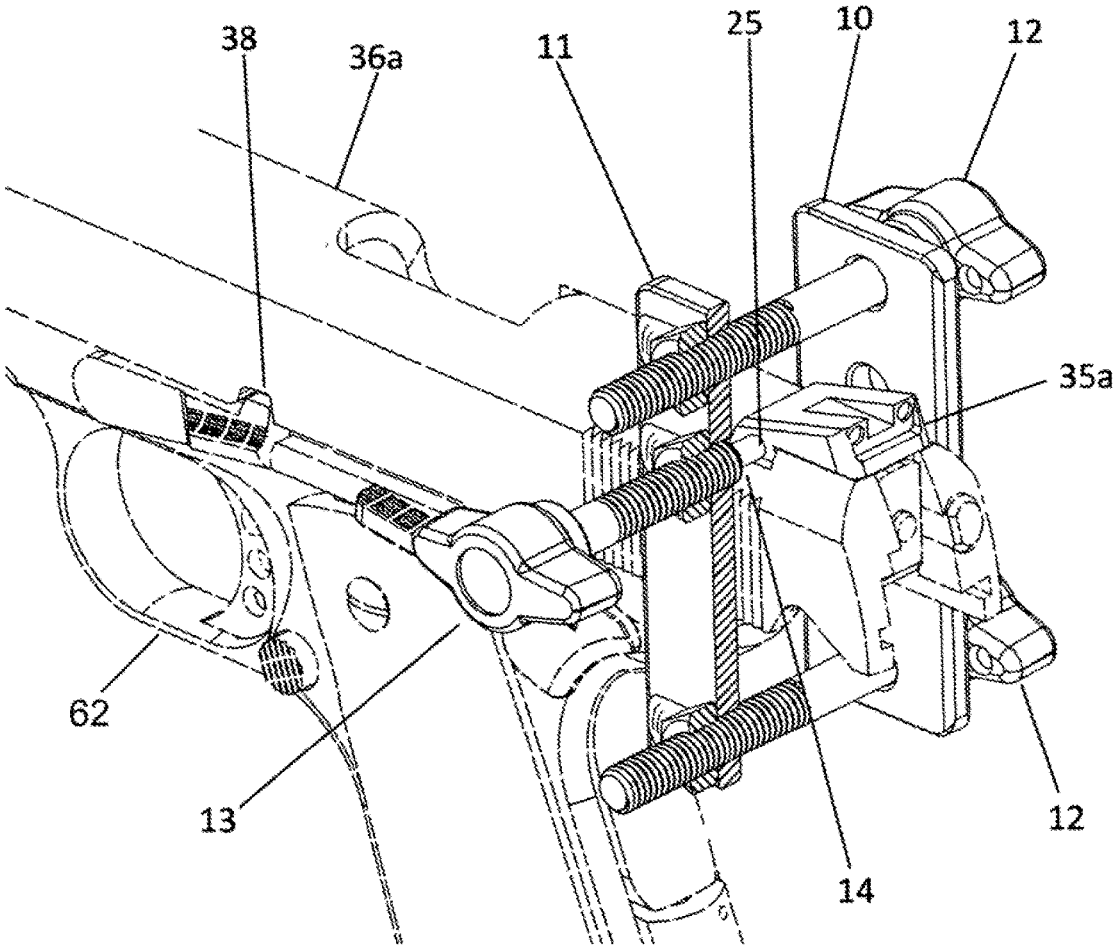
FIG. 14 shows a cross-sectional view of an embodiment of the present invention configured for sight adjustment without the spacer block or adapters in position.

Jumping to FIG. 14, a sight adjustment embodiment is clamped to a slide 36*a* that hasn't been removed from the frame 62. To prevent the slide 36*a* from closing, the slide 36*a* is secured by the slide catch 38. The embodiment is positioned on the slide 36*a* so the interchangeable pushing element 14 pushes in the lowest-centermost portion of the rear sight dovetail 25.

Figure 5:
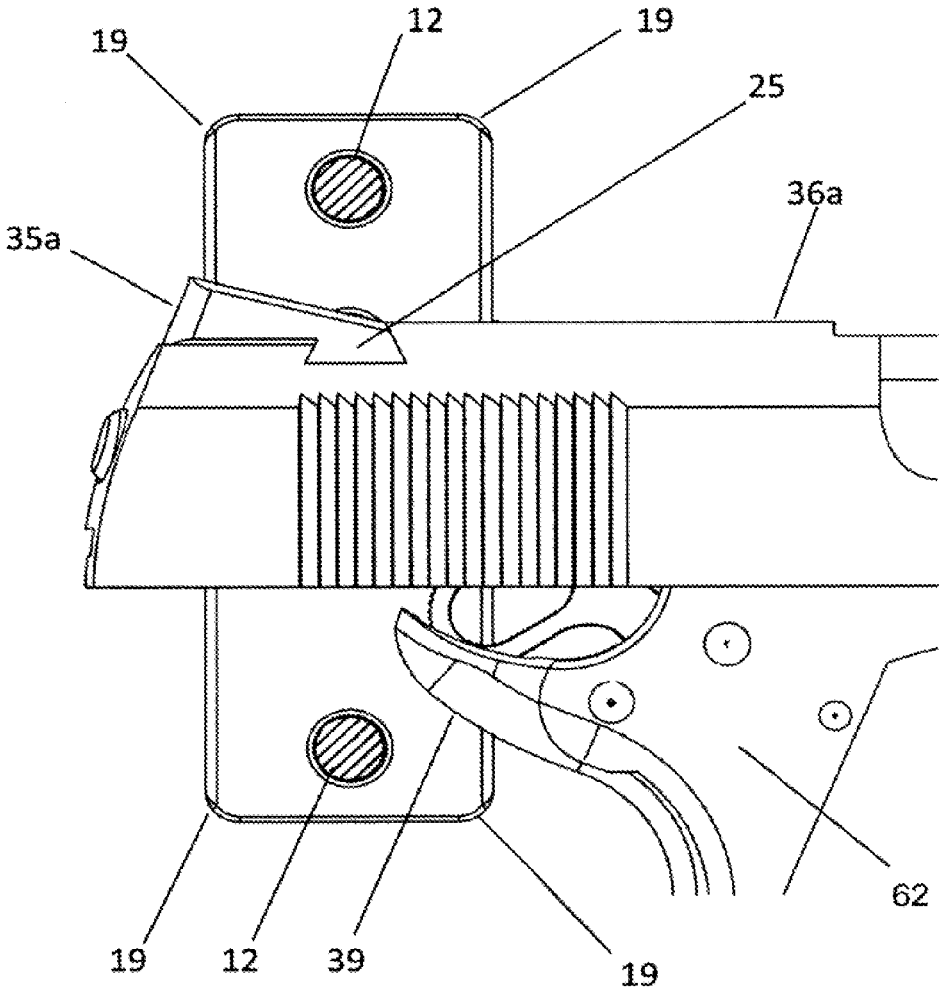
FIG. 5 is a sectioned illustrative representation of a device for the adjustment of sights of handguns as in FIG. 1 assembled on a handgun.
Figure 6:
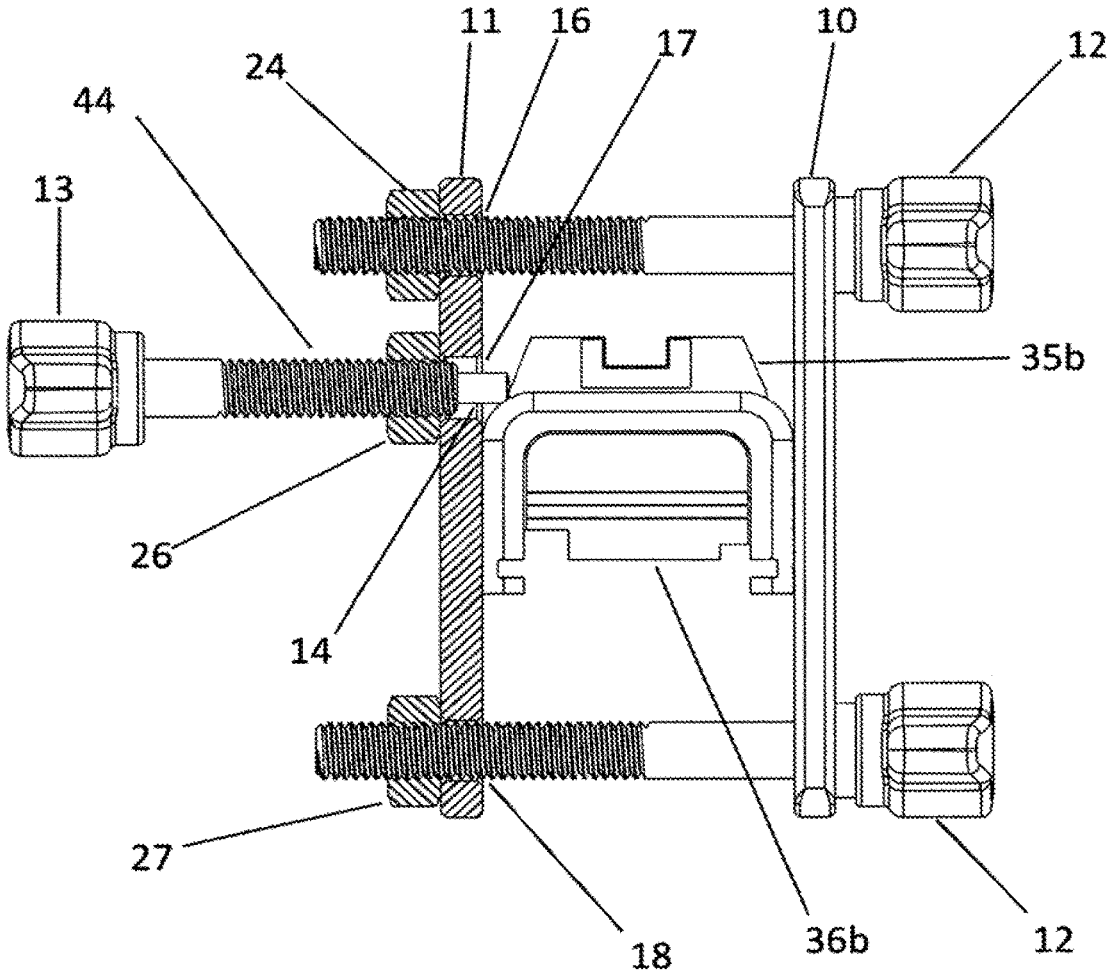
FIG. 6 depicts an alternate embodiment of the present invention unequipped with a spacer block or guiding plate.
Figure 7:
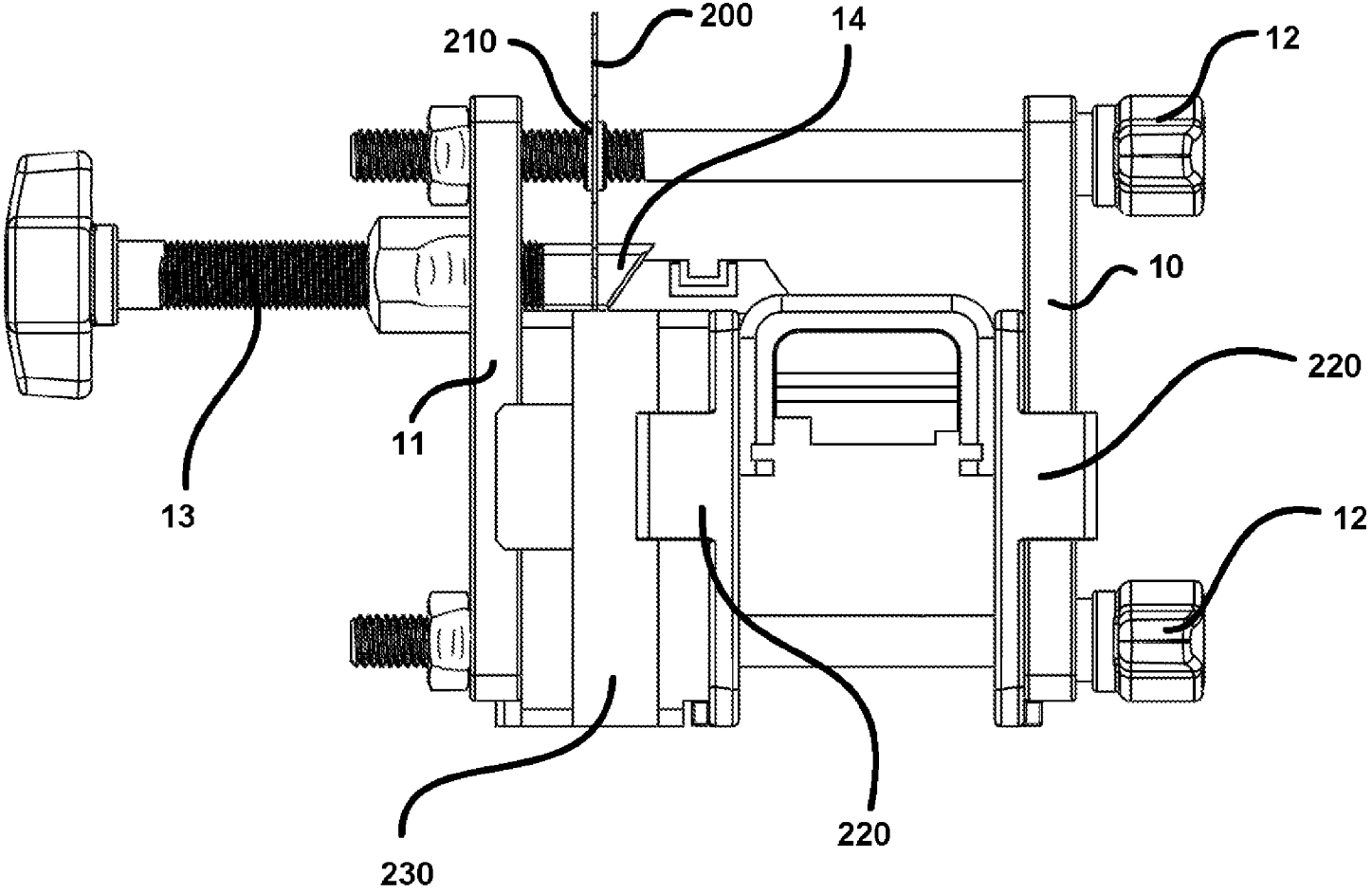
FIG. 7 is a view of the preferred embodiment of the present invention from the front, showing the present invention in use during a sight installation to a handgun.

Moving forward to FIG. 5, the dimensions of the embodiment are such that it allows for the accommodation of the beaver tail 39 from the frame 62 and the rear sight 35*a* between the tightening screws 12. Enough clearance is provided as to allow the accommodation of big beaver tails 39 and very tall rear sights 35*a* such as those meant for suppressor use. At FIG. 6, a design feature of the embodiment is highlighted. Some handguns feature very wide rear sights 35*b*. Due to this, the interchangeable pushing element 14 requires an area in which to retract, this being the center hole 17 from the plate with nuts 11. Additionally, the spacer block 230 provides for additional lateral space if needed.

The preferred embodiment of the present invention can be stored in a package having the plate 10 and plate with nuts 11 resting one on top of another. The accompanying tightening screws 12 and drift screw 13 with interchangeable pushing element 14 are situated in an interlacing manner next to the plates to minimize bulk. As known by anyone skilled in the art, the packaging 37 can be substituted for any different types of bags, varying in style and construction materials.

Figure 10:
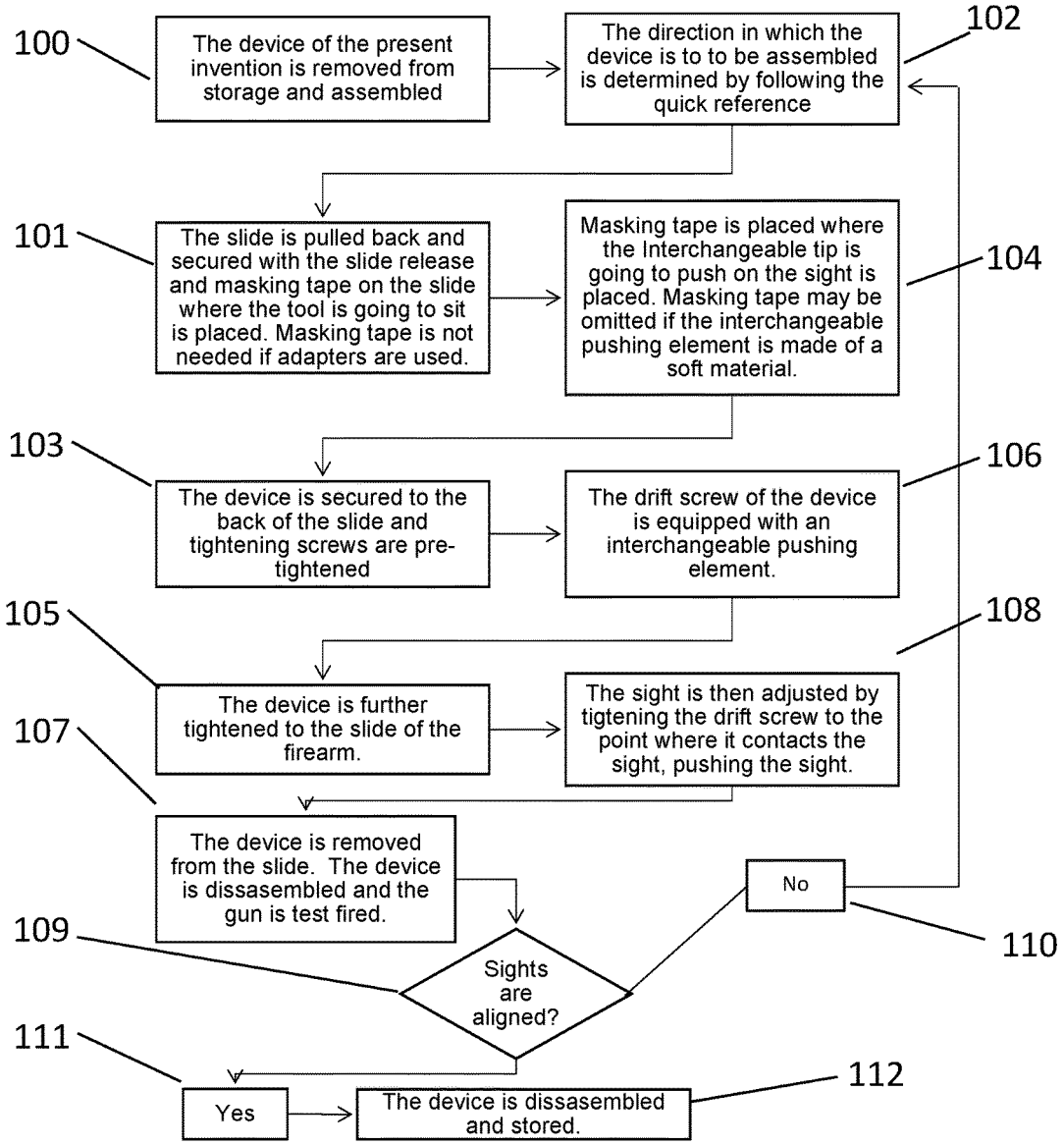
FIG. 10 is an illustrative flow chart of the procedure of use for a device for the adjustment of sights of handguns in accordance with the embodiments of the present invention.

To conclude, the FIG. 10 schematic flow chart will now be explained. Once the requirement of the adjustment of a rear sight 35*a* is determined, the user must proceed to withdraw the embodiment components from storage and assemble the basic structure of the present invention 100, to form an embodiment of the present invention. Construction of the present invention includes the following steps:

First, the user arranges the plate 10 and the plate with nuts 11 such that they are parallel, the plate 10 mirroring the plate with nuts 11. Next, the user affixes an adapter 230 to the plate 10 and/or the plate with nuts 11 via adapter clasps 260. The adapter clasps 260 are disposed on the adapter rear 280. An adapter accommodation 290, configured to receive a protrusion or extension of the sight such that it fits securely within the device of the present invention, is preferably oriented upwards, towards the drift screw 13. The user inserts the spacer block 230 in position (if needed) against an interior portion of the plate such that it faces the plate with nuts 11. If the spacer block 230 is employed, the adapter rear 280 is connected to the front of the spacer block 230 via adapter clasps 260. If the spacer block 230 is employed, the spacer block 230 is preferably held in position against the plate 10 or the plate with nuts 11 via a magnet 250. Then, the user inserts a first tightening screw 12 into a top hole 16 of the plate 11, passing through the first adapter 220, second adapter 220, spacer block 230, and finally emerging from the plate with nuts after threading through a nut of the plate with nuts. Then, the user inserts a second tightening screw 12 into a bottom hole 18 of the plate 11, passing through the plate 10, then the guiding plate bushing 210, and finally emerging from the plate with nuts 11 after threading through a bottom nut 27 of the plate with nuts 11.

Afterwards, the user must decide the orientation of the embodiment, or the direction in which the device is to be assembled is determined 102, as judging by how he or she needs to correct his or her impacts, the user will determine if his or her case is the one described by the quick reference 23, or the opposite case not shown on the quick reference 23. Then, the slide is pulled back and secured with the slide release and masking tape on the slide where the tool is going to sit is placed. Ideally, masking tape is not needed if adapters 220 and an interchangeable pushing element 14 made of soft material are used. 101 Masking tape is placed where the interchangeable pushing element 14 is to push on the sight. Masking tape is omitted if adapters are used instead, and the interchangeable pushing element 14 is made of a soft material. 104 The device is secured to the back of slide and the tightening screws 12 are pre-tightened 103 to allow the correct positioning of the embodiment to the slide 36*a*, as the drift screw 13 of the device is equipped with an interchangeable pushing element 14. 106 Once the correct positioning of the embodiment is obtained, the device is further tightened to the slide of the firearm 105, until the plate 10 and plate with nuts 11 start bending. The user then proceeds to adjust the sight by tightening the drift screw 13 as much as the user requires, to the point where it contacts the sight, pushing the sight. 108 Afterwards, the embodiment is removed from the slide of the handgun and all masking tape is removed (if used), the user may proceed to test fire the gun. 107 After the test fire, the user must evaluate if his or her shots land where they were intended 109. If not 110, the user will have to evaluate his or her adjustment again 102. If indeed the sights are accurately aligned 111, the user can proceed to disassemble the embodiment and place it in storage for later use 112.

In short, the method of use of the present invention is as follows:

For installing sights, the slide of the handgun should be disassembled from the frame of the firearm, and the barrel and recoil spring removed. For more convenient use of the present invention, securing the slide on a vice is recommended. The present invention is configured with an adapter 220 on the plate with nuts 11 and the spacer block 230 with (or without) an adapter 220 attached to the plate 10. Masking tape may alternatively be employed if adapters 220 are not present, or are not needed. The present invention is then clamped to the rear part of the slide of the firearm, and is then aligned using the interchangeable pushing element 14. Once the firearm is properly aligned, the drift screw 13 is tightened, and the sight can be removed from the slide by actuating the drift screw 13.

To install a sight, the present invention is detached from the slide. The adapter has to be popped off from the plate with nuts and the spacer block removed from the plate. After, the spacer block has to be attached to the plate with nuts, and the adapter has to be attached to the plate (if required).

To align the tool to the slide, the drift screw is extended as much as to clear the spacer block. Then the tool is attached to the slide, and the interchangeable pushing element 14 must touch the base of the dovetail 25 and be more or less centered on it. The new sight is rested on top the spacer block 230 and aligned by hand in position. Using the drift screw 13, the sight is inserted in slowly by tightening the drift screw 13.

For front sights, the process is very similar, but these additional steps must be taken:

a. The drift screw 13 may not be able to reach the front sight effectively, needing it to be assembled angled.

b. The spacer block 230 with the adapter 220 may need to be sided down as to allow the front sight to pass through.

c. The guiding plate 200 can be detached from the guiding plate bushing 210 and re-oriented as to the interchangeable pushing element 14 in order to achieve better contact with the sight if needed.

The process for adjusting (not removing or installing sights) is similar to the one used for sight installations, with the following differences:

1. For rear sight adjustments, there is no need to disassemble the slide from the gun.

2. The tool is assembled without the spacer block and using the short tightening screws.

3. Depending on the direction in which the point of impact (or center of the sight) needs to be moved, the tool can be assembled one way or the other.

Figure 3:
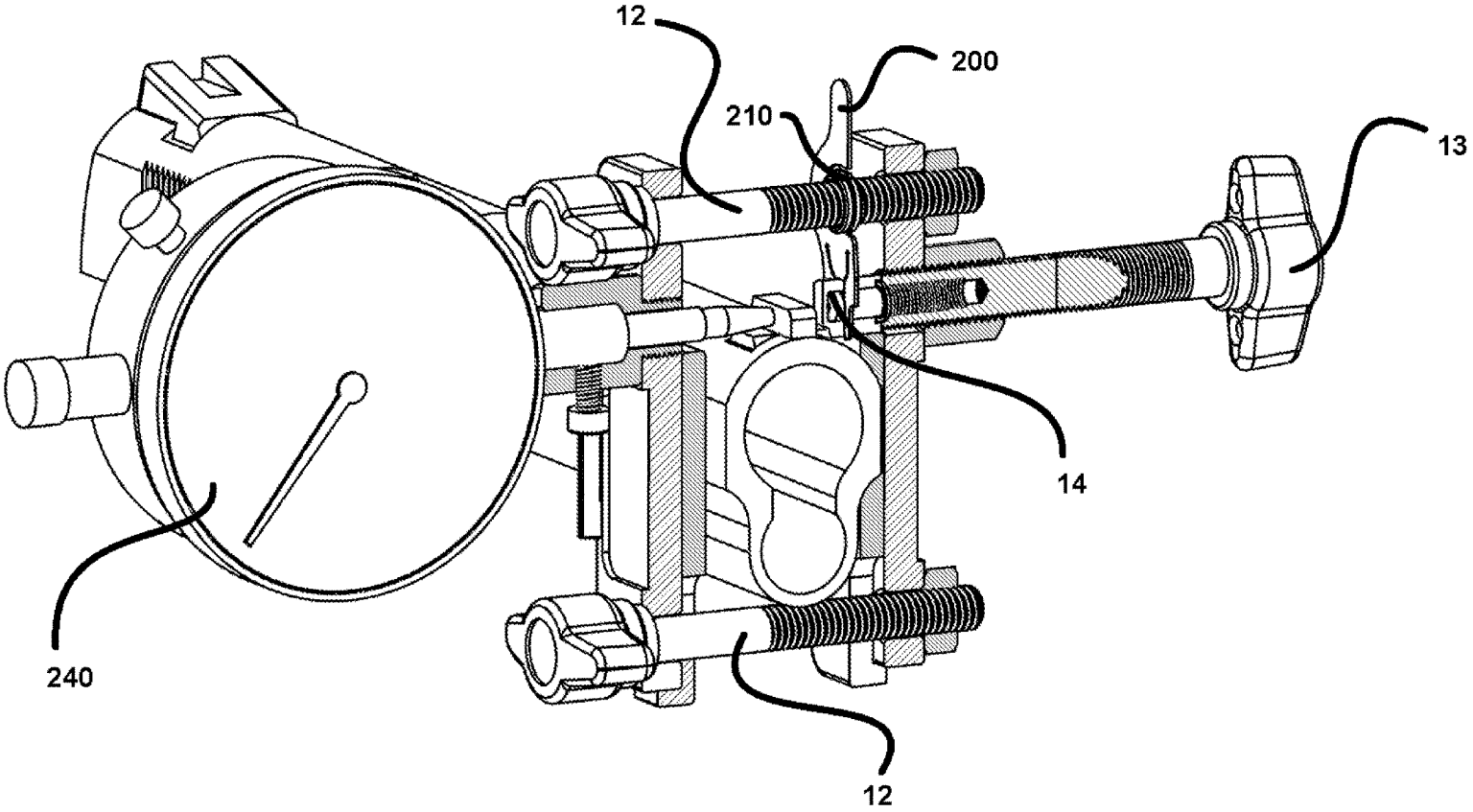
FIG. 3 exhibits a view of an alternate embodiment of the present invention having a dial indicator, as seen from the front.

It should be noted that the present invention may be equipped with a dial indicator 240 as shown in FIG. 3 in alternate embodiments. Such alternate embodiments equipped with the dial indicator 240 can achieve greater precision and accuracy when installing and adjusting a firearm sight via the present invention.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A device to facilitate the installation of a sight of a firearm comprising:

a first plate;

a second plate, said second plate equipped with a top nut, a center nut, and a bottom nut;

wherein said top nut, said center nut, and said bottom nut are welded into position over a second top hole, a second center hole, and a second bottom hole of said second plate respectively;

a center hole disposed at a center of said first plate, said center hole equipped with threading;

wherein said first plate is disposed parallel to said second plate, within the same plane;

a guiding plate;

a guiding plate bushing, said guiding plate bushing disposed on said guiding plate;

a spacer block;

a first adapter;

a second adapter;

wherein said first adapter is in communication with said first plate;

wherein said second adapter is in communication with said spacer block;

wherein said spacer block is disposed against an interior portion of said second plate;

a first tightening screw, said first tightening screw disposed such that it first extends through a first top hole in said first plate, then through said guiding plate bushing, then extending through said second top hole in said second plate, then threading to said top nut;

a second tightening screw, said second tightening screw disposed such that it first extends through a first bottom hole of said first plate, then through said first adapter, then through said second adapter, then through said spacer block, then through said second bottom hole of said second plate, then threading to said bottom nut;

a drift screw, said drift screw equipped with an interchangeable pushing element, said interchangeable pushing element at a first drift screw tip, and a knob at a second drift screw tip;

wherein said drift screw is in communication with said guiding plate;

wherein said drift screw, first tightening screw, and second tightening screw are threaded;

wherein said drift screw is configured to traverse through said second plate, held in position via said center nut;

wherein said drift screw is configured to screw towards said first plate, binding said interchangeable pushing element against the sight of the firearm, altering the position of the sight;

wherein said top nut is coaxial to said first top hole disposed in said first plate and said second top hole disposed in said second plate;

wherein said bottom nut is coaxial to said first bottom hole disposed in said first plate and said second bottom hole disposed in said second plate;

wherein said first adapter and said second adapter are equipped with adapter clasps;

wherein said first adapter and said second adapter are equipped with an adapter accommodation;

wherein said first adapter and said second adapter are made chosen from the group comprising: hard thermoplastic or metal injection molding;

a magnet;

wherein said magnet is disposed on a rear of said spacer block;

wherein said magnet is configured to maintain the position of the spacer block against the first plate;

wherein said spacer block is equipped with an open bottom;

wherein said first adapter and said second adapter are equipped with an open bottom;

wherein said open bottoms facilitate the removal of said first adapter, said second adapter, and said spacer block without disassembly of said first tightening screw and said second tightening screw from said first plate and said second plate;

protrusions, said protrusions disposed on a rear of said spacer block, a rear of said first adapter, and a rear of said second adapter;

wherein said protrusions facilitate the alignment of said spacer block, said first adapter, and said second adapter in position against said first plate and said second plate respectively;

wherein said guiding plate is in communication with said drift screw via said guiding plate bushing;

wherein said guiding plate bushing prevents the rotation of said guiding plate during rotation of said drift screw;

a tightening screw interface, said tightening screw interface disposed on said guiding plate; and wherein said tightening screw interface is closed.

* * * * *